United States Patent [19]

Wakefield et al.

[11] Patent Number: 4,552,289

[45] Date of Patent: Nov. 12, 1985

[54] TUNDISH FOR RIBBON CASTING OF SEMICONDUCTOR RIBBON

[75] Inventors: G. Felix Wakefield, Woodland Hills; David L. Bender, Thousand Oaks, both of Calif.

[73] Assignee: Atlantic Richfield Company, Los Angeles, Calif.

[21] Appl. No.: 147,804

[22] Filed: May 8, 1980

[51] Int. Cl.[4] ..... B22D 11/10

[52] U.S. Cl. ..... 222/600; 164/423; 164/437; 222/561

[58] Field of Search ..... 164/437, 438, 335, 87, 164/423, 427, 429, 336, 337, 439, 440; 222/590, 600, 591, 566, 561; 264/169, 165

[56] References Cited

U.S. PATENT DOCUMENTS

| | | | |
|---|---|---|---|
| 333,546 | 1/1886 | Prentiss et al. | 222/561 X |
| 1,756,196 | 4/1930 | Hopkins et al. | 164/87 |
| 2,051,201 | 8/1936 | Davidson | 264/169 |
| 2,308,034 | 1/1943 | Van Derhoef | 222/561 X |
| 2,931,082 | 4/1960 | Brennan | 164/88 X |
| 3,112,528 | 12/1963 | Czerkas | 264/169 |
| 3,522,836 | 8/1970 | King | 164/87 |
| 3,605,863 | 9/1971 | King | 164/87 X |
| 3,776,297 | 12/1973 | Williford et al. | 164/86 |
| 4,142,571 | 3/1979 | Narasimhan | 164/88 |
| 4,219,136 | 8/1980 | Williams et al. | 222/561 X |

*Primary Examiner*—Kuang Y. Lin

*Attorney, Agent, or Firm*—Nilsson, Robbins, Dalgarn, Berliner, Carson & Wurst

[57] ABSTRACT

A tundish for use in casting a ribbon of crystalline or coarse grain polycrystalline material, having a support for a hopper containing molten material, the hopper having a bottom plate and three side wall plates and a top plate, each made of a material which will not interact with the molten material contained within the space defined by the bottom plate, side wall plates and top plate, to impart any significant impurity into the molten material, and wherein the top plate slants downwardly towards the bottom plate to form an elongated orifice through which molten material is extruded onto a cool surface where crystallization of a ribbon of material occurs. As disclosed, the top plate is movable with respect to the bottom plate to change the thickness of the orifice. Also as disclosed, the top plate slides in a slot in each of two opposed side walls and is of a length such that it forms with the third side wall an opening into which molten material is added to the tundish.

8 Claims, 6 Drawing Figures

TUNDISH FOR RIBBON CASTING OF SEMICONDUCTOR RIBBON

RELATED APPLICATIONS

The present application is related to application Ser. No. 148,319 in which the present inventors are co-inventors and application Ser. No. 147,765 in which one of the present inventors is the inventor.

BACKGROUND OF THE INVENTION

The present invention relates to a novel tundish useful in the casting of a continuous ribbon of material, e.g., semiconductor material.

More particularly, this invention concerns a tundish having a support for a hopper containing molten material, e.g., semiconductor material, the hopper having a bottom plate and three sidewall plates and a top plate, each made of a material which will not interact with the molten semiconductor material contained within the space defined by the bottom plate, sidewall plates and the top plate, to impart any significant impurity into the molten material, and wherein the top plate slants downwardly towards the bottom plate to form an elongated orifice through which molten material is extruded onto a cool surface where the crystallization of a ribbon of the material occurs.

The invention also relates to the top plate, bottom plate, or both being movable with respect to the other to change the thickness of the orifice, with the top plate and/or bottom plate being slideably mounted in a slot in each of two opposed sidewalls and the top plate being of such a length that the top plate forms, with the third sidewall, an opening into which molten material is added to the tundish.

Ribbon casting of a ribbon of crystalline and/or coarse grain polycrystalline material, e.g., semicondoctor material, occurs when a thin ribbon of molten material is forced or extruded onto a cool surface, which is usually moving with respect to the source point of extrusion of the molten material. Usually this is done by forcing or extruding the semiconductor material onto a rotating drum which is cooled so that crystallization will occur while the ribbon is in contact with the surface of the drum.

It is desirable to have a tundish which will supply the molten material to the surface of the rotating drum in a thin ribbon which is adjustable to a variety of desired thicknesses at the point of extrusion. This enables the precise setting of the thickness of the crystallized ribbon of the material, which is determined by the thickness of the extruded molten ribbon of material and the amount of stretch of the ribbon between the orifice and the cooled surface, which in turn depends on the type of material, its temperature, the distance between the orifice and the point of contact on the cooled surface and the speed of rotation of the cooled surface of the drum. It is also desirable that the material of the tundish be such that it will not interact with the molten material to impart any impurity to the molten material. This is particularly true when the molten material is semiconductor material being cast into a ribbon for use in, e.g., a photovoltaic cell, where even slight amounts of impurities in the semiconductor material can cause a significant decrease in the efficiency of the cell.

It is also desirable that the tundish contain a heating element to maintain the temperature of the molten material above the temperature at which crystallization of the molten material will commence and also to heat the orifice of the tundish through which the ribbon of molten material is extruded in order to insure that the molten material is extruded onto the rotating drum in a molten state.

The problems enumerated above which must be overcome in providing an adequate tundish for ribbon casting of crystalline or polycrystalline material, are not intended to be exhaustive, but, rather, are among many which tend to impair the effectiveness of previously known methods or apparatus for supplying molten material to the surface of the rotating drum. Other noteworthy problems may also exist, however, those presented above should be sufficient to demonstrate that there is a need appearing in the art for an improved apparatus for supplying molten material to the rotating drum surface.

SUMMARY OF A PREFERRED EMBODIMENT OF THE INVENTION

Recognizing the need for an improved apparatus for supplying molten material, e.g., semiconductor material, to the cooled surface of a rotating drum for fabricating a continuous ribbon of crystalline or coarse-grain polycrystalline material, it is a general feature of the present invention to provide a novel tundish which minimizes or reduces the problems of previously known apparatus for supplying the molten material to the cool surface of the rotating drum.

More particularly, the present invention relates to a tundish for use in casting a ribbon of crystalline or coarse-grain polycrystalline material, e.g., semiconductor material, which has a support for a hopper containing the molten material, with the hopper having a bottom plate and at least two sidewall plates and a top plate, each made of a material which will not interact with the molten material to impart any significant impurity into the molten material contained within the space defined by the bottom plate, sidewall plates and top plate, and wherein the top plate slants downwardly toward the bottom plate to form an elongated orifice through which the molten material is extruded onto the surface of the rotating drum. The invention also relates to the top plate, bottom plate, or both, being movable with respect to the other to change the thickness of the orifice.

Examples of the more important features of the present invention have thus been summarized rather broadly in order that the detailed description thereof that follows may be better understood, and in order that the contribution to the art may be better appreciated. There are, of course, additional features of the invention which will be described hereafter and will also form the subject of the appended claims. These other features and advantages of the present invention will become more apparent with reference to the following detailed description of a preferred embodiment thereof in connection with the accompanying drawings, wherein like reference numerals have been applied to like elements in which:

DETAILED DESCRIPTION OF A PREFERRED EMBODIMENT

Figure 1:
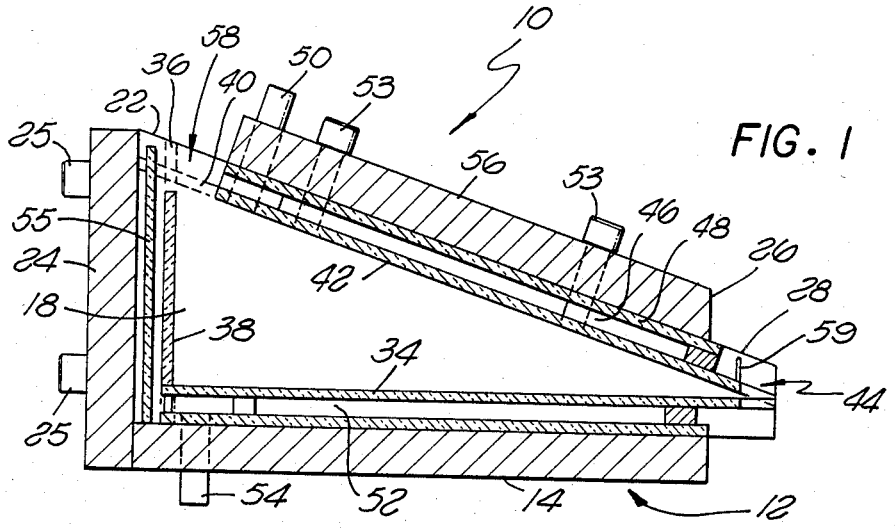
FIG. 1 shows a side cross-sectional view of the tundish according to the present invention.
Figure 2:
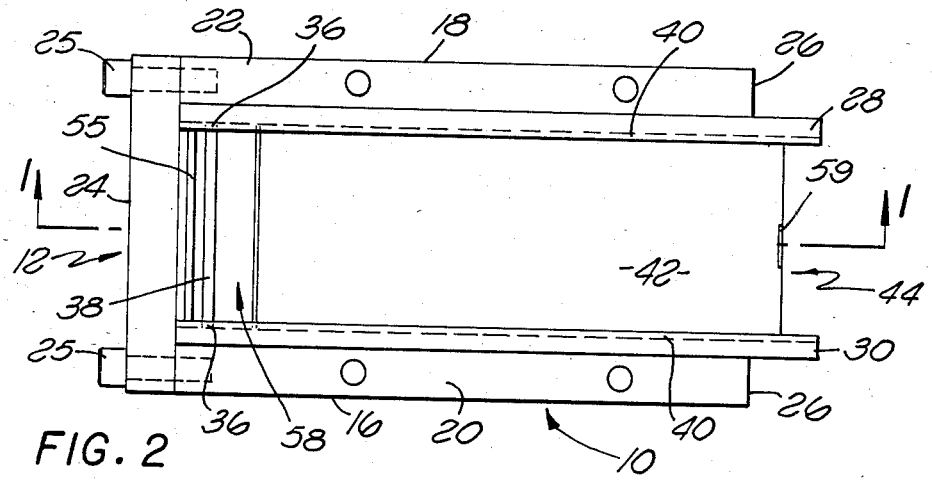
FIG. 2 shows a plan view of the tundish shown in FIG. 1 with the removal of the heating element, insulator plate and cover, which are shown in FIG. 1 above the top plate of the tundish hopper.
Figure 3:
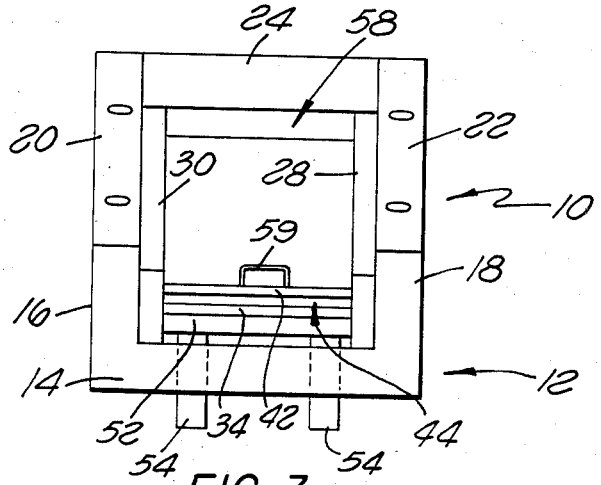
FIG. 3 shows a front elevational view of the tundish of FIGS. 1 and 2, with the same elements removed as are removed in FIG. 2.

Turning now to FIGS. 1, 2 and 3, a tundish 10 according to the present invention is shown. In order for the tundish 10 to be useful in the casting of a continuous ribbon of crystalline or polycrystalline material, the material of the tundish must be such as not to interact with the molten material contained within the tundish to impart any impurities into the molten semiconductor material. This is particularly crucial when the molten material is semiconductor material. The tundish 10 is useful for the production of a ribbon of semiconductor material from molten semiconductor material consisting of any of a large number of well known semiconductor materials, e.g., silicon, germanium, gallinium arsenide, boron-doped silicon, and phosphorous-doped silicon. Quartz is therefore useful as a material for constructing the tundish 10, since quartz has a melting temperature well above all but the silicon-containing semiconductor materials, and will therefore not interact with such molten semiconductor materials to impart any impurity into the semiconductor material. Further, with respect to the silicon containing semiconductor materials, since quartz is $SiO_2$, any interaction between the quartz and molten semiconductor materials containing silicon, should any portion of the surface of the quartz become molten when contacted by the molten semiconductor material, will not impart any impurities into the silicon-containing semiconductor material, apart from acceptable minute amounts of oxygen. However, as is known in the art, a quartz receptacle for molten silicon will become soft and deformable. Thus the tundish 10 must have a support for the quartz receptacle for the molten silicon.

FIGS. 1–3 show a support 12 which has a base member 14 and two opposed upstanding members 16, 18 which are integral with the base 14. The upstanding members 16, 18 each have an upper surface, respectively 20, 22, which slants downwardly toward the front end 14 of the tundish 10. A rear end plate 24 is attached to the rear ends of the upstanding members 16, 18 by screws 25 to enclose the rear end of the tundish 10. The base 14 and upstanding members 16, 18 and the rear end plate 24 are constructed of a material which has sufficient rigidity and heat resistant characteristics to support the quartz of the tundish 10 when the tundish 10 contains molten silicon. Such a material may be graphite or any of a number of suitable ceramic insulating materials well known in the art.

The tundish 10 itself is contained within the tundish support 12 and generally comprises a hopper for holding and dispensing molten semiconductor material, e.g., silicon. The tundish 10 has a first sidewall plate 28 and a second sidewall plate 30 adjacent the inwardly facing surfaces of the upstanding members, respectively, 16 and 18.

Figure 5:
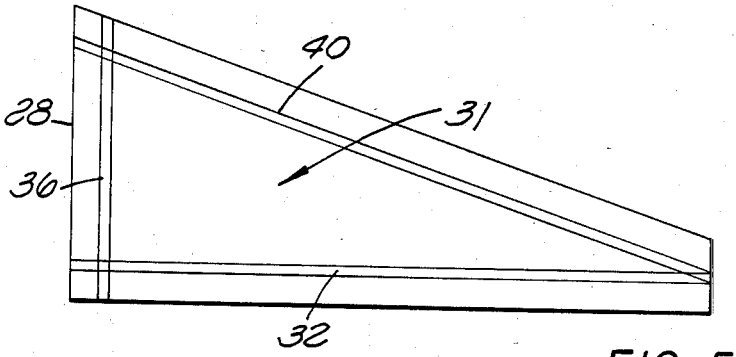
FIG. 5 shows a side elevational view of the tundish sidewall liner plate and the associated slots on the inwardly facing surface of the sidewall liner plate.

Turning now to FIG. 5, the first sidewall plate 28 is shown in a side elevational view looking at the inwardly facing surface 31 of the first sidewall plate 28. As is shown in FIG. 5, the inwardly facing surface 31 of the first sidewall plate 28 has a slot 32. A corresponding slot 32 exists in the corresponding inwardly facing surface of the second sidewall plate 30. Turning back to FIGS. 1–3, a bottom plate 34 is inserted in the respective slots 32 and constitutes the bottom of the tundish 10. The inwardly facing surface 31 of the first sidewall plate 28 also has a slot 36, as is shown more particularly in FIG. 5. A corresponding slot 36 exists on the corresponding inwardly facing surface of the second sidewall plate 30. A rear wall plate 38 (as shown in FIGS. 1–3) is inserted in the corresponding slots 36 and contacts the bottom plate 34 to form a rear wall for the tundish 10. Slots 40 also exist on the respective inwardly facing surfaces of the first and second sidewall plates 28, 30, as is shown more particularly in FIG. 5, with respect to the inwardly facing surface 31 of the first sidewall plate 28. The slots 40 slant downwardly towards the front end of tundish 10. A top plate 42 is slideably mounted within the respective slots 40 on the first and second side plates 28, 30. The grooves 40 and 32 on the respective first and second side plates 28, 30 converge and intersect at the front end of the side plates 28, 30. As shown in FIGS. 1–3, the bottom plate 34 and the top plate 42 do not extend to a point in the slots 32, 40 where they would intersect, but rather, the front ends of the bottom plate 34 and top plate 42 form an elongated narrow orifice 44.

Each of the bottom, side, rear, and top plates 34, 28, 30, 38, and 42, are conveniently constructed of annealed clear quartz, or other suitable material, as discussed above.

Figure 4:
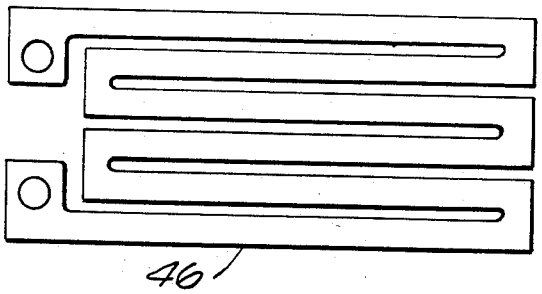
FIG. 4 is a plan view of the heating elements of the tundish.

Above the top plate 42 is a heating element 46, which is shown on greater detail in a plan view in FIG. 4. The heating element 46 may be composed of any suitable material, e.g., graphite-ultracarbon U120 or graphite cloth of fibres woven into a fabric. Above the heating element 46 is a quartz insulating plate 48. As is shown in FIGS. 1 and 4, the heating element is formed to have essentially a flat configuration, to allow it to fit in the space reserved for it between the top plate and the insulating plate. The top plate 42, heater element 46, and quartz insulating plate 48 are joined together by two electrodes 50 which each pass through one of a respective pair of holes in the quartz insulating plate 48 and the heating element 46. A cover 56 composed of the same material as the tundish support 12 is attached across the upper surfaces 20, 22 of the first and second upstanding members 16, 18 of the tundish support 12 by screws 53. The electrodes are screwed into heating element 46, pass through insulating plate 48, and also pass through holes (not shown) in the cover 56, being insulated from the cover 56. In the embodiment shown in FIGS. 1–3, the electrodes 50 do not extend through the heating element into the top plate 42. Thus a handle 59 is provided to move the slideably mounted top plate 42 within the slots 40 to adjust the thickness of the orifice 44, i.e., the distance between the lower edge of the front end of the top plate 42 and the upper edge of the front end of the bottom plate 34. Alternatively, the electrodes 50 could have a screw-threaded extension (not shown) which could extend through the heating element 46 and be threaded into threaded holes (not shown) in the top plate 42. In this alternate embodiment, movement of the electrode in a direction parallel to the top plate 42 would provide a means for sliding the top plate 42 in the slots 40. In this alternate embodiment, the cover 56 may have a pair of slots (not shown) through which the electrodes 50 pass and which allow the electrodes 50 to move within the slots in the cover 56 when the top plate 42 slides within the respective slots 40 in the first and second sidewall plates 28, 30 as the electrodes are moved in a direction parallel to the top plate 42.

A heating element 52 which is of the same construction as heating element 46 shown in FIG. 4, is disposed between the bottom plate 34 and the base 14 of the tundish support 12. A pair of electrodes 54 pass through holes in the base 14 and make electrical contact with the heating element 52. An additional insulating plate is disposed between the rear plate 38 of the tundish 10 and the rear wall 24 of the tundish support 12. The top plate 42 and the rear plate 38 of the tundish 10 do not extend to the point of intersection of the respective slots 40, 36 and leave an opening 58 into which molten semiconductor material may be inserted into the hopper-like space defined by the bottom, side, rear and top plates 34, 28, 30, 38 and 42 of the tundish 10.

Figure 6:
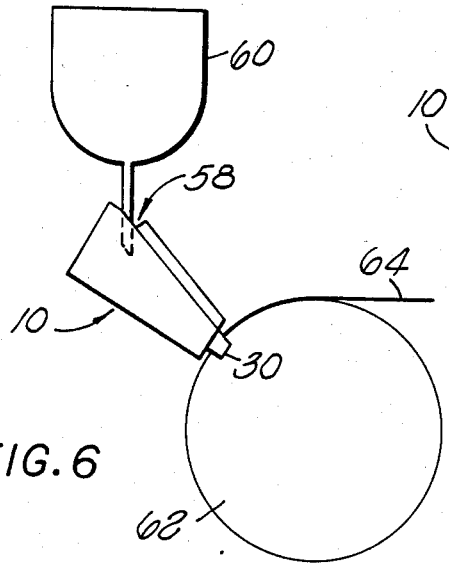
FIG. 6 is a schematic view of the tundish and the associated rotating drum and a source of molten material; and, FIG. 7 is an enlarged and partially cut-away plan view of the tundish and associated rotating drum.

FIG. 6 shows schematically how the tundish 10, according to the present invention, is used in an apparatus for the casting of a crystalline or coarse-grain polycrystalline ribbon of semiconductor material. The tundish 10 is supplied with molten semiconductor material through opening 58 by a source 60 of molten semiconductor material. The crystallization of the molten semiconductor material extruded through the orifice 44 onto a cooled surface which is moving in relation to orifice 44. The cooled surface of a rotating drum 62 can be cooled by any suitable means, for example, by an inert gas or water at, e.g., 70°, passing through the interior of the drum 62 and under the surface onto which the molten semiconductor material is extruded. The molten semiconductor material crystallizes as it moves away from the tundish 10 on the surface of the rotating drum 62 to form a ribbon 64 which is separated from the surface of the rotating drum 62 and taken up on a takeup reel (not shown).

Figure 7:
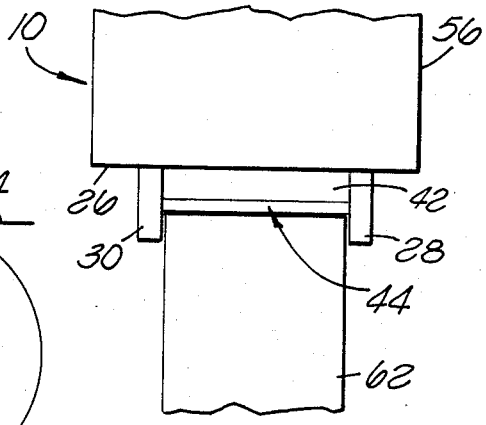

In FIG. 7 the manner in which the rotating drum 62 fits adjacently orifice 44 is shown in greater detail. As was explained above, the side plates 28, 30 of the tundish 10 extend outwardly from the front end 26 of the tundish support 12, the top 56 of which is shown in FIG. 7. In addition, the top plate 42 and bottom plate 34 (not shown in FIG. 7) extend outwardly from the front end 26 of the tundish support 12, but not as far as the side plates 28, 30. Thus the orifice 44 defines an elongated thin passageway through which molten semiconductor material is extruded as a ribbon onto the surface of the rotating drum 62 which is of a width approximately equal to that of the orifice 44 but slightly narrower in order to allow clearance between the rotating drum 62 and the inwardly facing surfaces of the side plates 28, 30. Thus a ribbon will be formed due to the crystallization of the molten semiconductor material on the surface of the rotating drum which is of a width equal to the width of the orifice and approximately equal to the width of the rotating drum 62. The thickness of the cast ribbon is determined by the thickness of the orifice and the amount of stretch of the molten material between exiting the orifice 44 and contacting the cooled surface of the drum 62. The stretching will occur due to the rotating drum 62 pulling the ribbon of molten semiconductor material away from the orifice 44, which will tend to stretch the molten material slightly, before crystallization commences on the drum 62 surface, thereby reducing slightly the thickness of the cast ribbon. The amount of stretching is a function of, among others, the type of material, the distance between the drum 62 surface, at the point of contact of the material with the drum 62, and the orifice, and the drum 62 speed. By controlling the thickness of the orifice 44 opening, therefore, it is possible to very precisely control the thickness of the cast ribbon. This is especially important in the range of 5–30 mils, which are the approximate thicknesses desired for cast ribbons of semiconductor material for photovoltaic cell applications.

In the present application, "extrude" is used in the sense of being both forced through the orifice 44, due to the weight of the molten material above the orifice 44, and being drawn onto the drum 62 surface by surface tension within the molten ribbon, as the ribbon is cast on the drum 62 surface.

SUMMARY OF THE ADVANTAGES AND SCOPE OF THE INVENTION

It will be appreciated that in constructing a tundish according to the present invention, certain significant advantages are provided.

In particular, a tundish is provided to contain and control the flow of a molten material, e.g., semiconductor material, as a thin ribbon onto a moving cooled surface where crystallization of the molten material can occur to form a continuous ribbon of crystalline or coarse-grain polycrystalline material. The tundish has two plates which converge to form an elongated orifice of narrow thickness convenient for depositing molten material onto the moving cooled surface in a ribbon-like configuration and the plates are movable with respect to each other to conveniently adjust the thickness of the extruded ribbon of molten material. In addition, the tundish is advantageously constructed of quartz or other suitable material, so as not to contaminate the molten material and has a support surrounding the quartz portions of the tundish for supporting the quartz plates forming the tundish when the tundish contains a molten semiconductor material having a melting point near that of the quartz material of the tundish, e.g., silicon. The support may preferably be contructed of any suitable insulating material to conserve the heat energy of the molten material contained in the tundish. Additional heating elements, e.g., on the interior faces of the support upstanding members and rear wall could be used to improve the uniformity of the thermal distribution inside the tundish. Another advantage of the structure of the present invention is the inclusion of heater elements which serve to both maintain the molten state of the semiconductor material inside the entire tundish and to heat the plates of the tundish forming the orifice so that the orifice is at a sufficient temperature to guarantee that the semiconductor material extruded through the orifice is in the molten state. In addition, the convergence of the top plate and bottom plate at a relatively acute angle to form the orifice, enables the tundish to be used in a variety of orientations, from that with the bottom plate approximately horizontal to that with the bottom plate approximately vertical, an intermediate position being shown in FIG. 6.

The foregoing description of the invention has been directed to a particular preferred embodiment in accordance with the requirements of the Patent Statutes and for the purposes of explanation and illustration. It will be apparent, however, to those of ordinary skill in this art that any modifications and changes in both the apparatus and the method of the present invention may be made without departing from the scope and spirit of the invention. For example, the particular shape of the tundish support is not crucial to the present invention, so long as the quartz walls of the tundish are given adequate support. Further, while quartz is a suitable material for the tundish plates for silicon, other plate materials may be preferred for the tundish plates for molten material of other semiconductor materials, or for other materials, e.g., metals, of which it may be desired to cast a crystalline or coarse-grain polycrystalline ribbon, depending on the melting temperature of the plate material as opposed to the melting temperature of the material to be cast, and the composition of the plate material with relation to whether the interaction of the plate material at the surface of the plates would impart any undesirable contaminant into the molten material to be cast. In addition, both the top plate and bottom plate, or only the bottom plate may be slideably mounted in their respective slots for purposes of changing the thickness of the orifice. The tundish may be used without the rear end of the support, the rear plate of the tundish and the rear insulating plate, with a tilted orientation of the tundish, as shown in FIG. 6, serving to retain the molten material within the tundish. However heat loss through the large opening created by removal of the rear end, rear plate and rear insulating plate would be detrimental.

It will further be apparent that the invention may also be utilized with suitable modifications within the state of the art, and that these modifications will be apparent to those skilled in the art. It is the applicant's intention in the following claims to cover all such equivalent modifications and variations as fall within the true spirit and scope of the invention.

What is claimed is:

1. A tundish useful in casting a ribbon of material comprising:

a hopper for the molten material having a bottom plate and at least two side wall plates and a top plate, said top plate converging with said bottom plate to form an elongated orifice for extruding the material therethrough, at least one of said top plate and bottom plate being movable with respect to said other of said top plate and bottom plate to change the thickness of said orifice; and a heating element to provide heat to the molten material, including at least a portion having a substantially flat configuration oriented substantially parallel to a surface of one of said top and bottom plates, said surface being opposite the surface of said plate for facing the molten material within the hopper.

2. The tundish of claim 1 wherein said portion of said heating element is oriented substantially parallel to a said surface of said at least one movable plate.

3. The tundish of claim 2 wherein said portion of said heating element is adjacent said surface to which it is oriented substantially parallel.

4. The tundish of claim 1 wherein said portion of said heating element is adjacent said surface to which it is oriented substantially parallel.

5. The tundish of claim 1 wherein said heating element is a resistive heating element shaped to provide an elongated path for electrical current therethrough.

6. The tundish of claim 1 further comprising a second heating element to provide heat to the molten material, said second heating element including at least a portion having a substantially flat configuration oriented substantially parallel to a surface of said other one of said top and bottom plates, said surface of said other one of said top and bottom plates being opposite the surface of said plate for facing the molten material within the hopper.

7. The tundish of claim 6 wherein said portion of said second heating element is adjacent said surface to which it is oriented substantially parallel.

8. The tundish of claim 6 wherein said second heating element is a resistive heating element shaped to provide an elongated path for electrical current therethrough.

* * * * *